US006568835B2

(12) United States Patent
Wijbenga et al.

(10) Patent No.: US 6,568,835 B2
(45) Date of Patent: May 27, 2003

(54) LUMINAIRE

(75) Inventors: Hendrik Wijbenga, Eindhoven (NL); Jean Paul Entrop, Eindhoven (NL); Cornelis Johannes Maria Erkamp, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/101,308

(22) Filed: Mar. 19, 2002

(65) Prior Publication Data

US 2002/0154506 A1 Oct. 24, 2002

(30) Foreign Application Priority Data

Mar. 23, 2001 (EP) ..... 01201099
Oct. 22, 2001 (EP) ..... 01204011

(51) Int. Cl.[7] ..... F21V 7/00

(52) U.S. Cl. ..... 362/349; 362/346; 362/347; 362/297

(58) Field of Search ..... 362/347, 349, 362/346, 348, 297, 296

(56) References Cited

U.S. PATENT DOCUMENTS 3,588,492 A * 6/1971 Pollock ..... 240/41.1
4,236,193 A * 11/1980 Brandt ..... 362/241
4,293,901 A * 10/1981 Hernandez ..... 362/346
4,450,513 A * 5/1984 Guggemos ..... 362/299
5,690,422 A * 11/1997 Brass ..... 362/297
5,812,246 A * 9/1998 Claes et al. ..... 355/99

FOREIGN PATENT DOCUMENTS

WO WO09845643 10/1998 ..... F21V/7/12

OTHER PUBLICATIONS

NL 000190, Entitled Luminaire, Filed Apr. 2, 2001, Serial Number 09/824,619, Inventor: F.G.P. Sools. Pending Application.

* cited by examiner

*Primary Examiner*—Laura K. Tso
(74) *Attorney, Agent, or Firm*—Frank Keegan

(57) ABSTRACT

The luminaire comprises a concave reflector (1) with an optical center (2) on an optical main axis (3), in an optical main plane (4). A screen (6) extends along the main axis (3) up to a light emission window (5). A panel (7) extends at a first side of the main plane (4) from the screen (6) up to the light emission window (5). The reflector (1) includes a first, faceted reflector portion (10) at the first side of the main plane (4), which extends towards the main plane (4), and which may be parabolically curved, the optical center (2) being its focus and the main axis (3) being its axis. A second, faceted reflector portion (20) is present at the other side of the main plane (4) and may be parabolically curved, which reflector portion has a side axis (22) passing through the optical center (2), and a focus lying in the optical center (2). The side axis (22) is tilted, with respect to the main axis (3), through acute angles in the main plane (4) and out of said main plane (4). The luminaire provides a screened-off light beam which is asymmetrical in horizontal planes as well as in vertical planes, as a result of which said luminaire can suitably be used to illuminate highways in the oncoming-traffic direction.

17 Claims, 6 Drawing Sheets

LUMINAIRE

The invention relates to a luminaire comprising:

a concave reflector with an optical center on an optical main axis in an optical main plane;

a light emission window which includes an acute angle with the optical main axis and extends transversely to the optical main plane;

a reflective screen which extends along the optical main axis of the reflector up to the light emission window, and extends transversely to the optical main plane;

a side panel at a first side of the main plane, contiguous to the screen, which reaches into the light emission window and bounds the reflector;

means for accommodating an electric lamp with a light source, which light source is situated around the optical center, which reflector comprises elongated facets which extend along the screen.

Such a luminaire is disclosed in WO 98/45 643 (PHN 16295).

The known luminaire is intended to be used for the illumination of sites, for example sports fields, or to illuminate the road surface in a road tunnel, in which cases the light emission window is arranged horizontally, or it may also be used to illuminate facades, in which case the light emission window is arranged vertically.

The known luminaire comprises a reflector with a central row of facets, which is intersected by the optical main plane, which is a plane of symmetry in this luminaire, and, on each side thereof, one row of facets arranged at an angle therewith and bounded by a relevant side panel. The luminaire can suitably be used to accommodate a lamp having an elongated light source extending transversely to the plane of symmetry.

The known luminaire provides a light beam which, if the light emission window is horizontally arranged, is symmetrical in horizontal planes and asymmetrical in vertical planes. The reflective screen which, in this case, is in an oblique position facing downwards thus precludes that light is emitted at a large angle with the vertical. It is thus precluded that an observer looking at the luminaire from a distance is blinded if he looks against the light beam. As a result, the luminaire can very suitably be used to illuminate road tunnels, in which case the luminaire is mounted in the center of the ceiling of the tunnel and emits light against the direction of the traffic. Said luminaire thus illuminates both the road surface and the walls of the tunnel. To provide uniform illumination, a plurality of similar luminaires are mounted at a comparatively small distance from each other.

The illumination of a road surface by means of a light beam emitted against the direction of the traffic is very effective. In this case, light reflected by the road surface travels substantially upward towards the road user, enabling said road user to see the road surface. As regards the commonly used roadway lighting, the luminaires emit light, from a mast, in a downward direction on either side of the mast, half of the light being emitted on the side of the mast facing away from the road user. Said light is partly diffusely scattered by the road surface and partly reflected in a direction away from the road user so that it remains partly unobserved by the user. If the road surface is reflective, as in the case of, for example, a smooth bitumen surface, but particularly when the road surface is wet, the specular reflection by the road surface is greater and diffuse scattering is smaller. In this case the road surface is very dark. Also the light generated by the road user's own vehicle is specularly reflected away from the road user.

In the case of light traveling in the direction of the road user, however, much light is reflected towards the road user in the case of a specular, for example wet, road surface, resulting in good visibility of the road surface.

A drawback of the known luminaire resides in that if said luminaire is to be used as a road surface lighting, against the direction of the traffic, it must be mounted centrally above the section of the road where the traffic flow is unidirectional, as a result of which portals must be provided above the road, causing the application of the luminaire to be expensive. Another drawback resides in that the substantial amount of light that is incident on a tunnel wall if the luminaire is used for illuminating a tunnel, will be incident on the side of the road for oncoming traffic if said luminaire is used as a roadway lighting. Apart from the fact that this light cannot effectively be used for the intended purpose, it is undesirable because it is emitted in the direction of flow of the oncoming traffic.

It is an object of the invention to provide a luminaire of the type described in the opening paragraph, which can suitably be provided at a side of a roadway so as to uniformly illuminate a side of a road against the direction of flow of the traffic on said side of the road.

In accordance with the invention, this object is achieved in that the reflector is provided with:

a first reflector portion with facets, which extends, on the first side of the main plane, from the side panel to at least close to the main plane, and defines the main axis and the optical center, a second reflector portion with facets, which extends opposite the side panel between the screen and the light emission window, on a second side of the main plane, which second reflector portion has a side axis which extends essentially through the optical center and is tilted essentially in the optical center with respect to the main axis towards the light emission window so as to include an acute angle $\alpha$ with the main axis upon projection in the main plane, and towards the side panel to include an acute angle $\beta$ with the main plane; and a third concave reflector portion interconnecting the first reflector portion and the second reflector portion.

In operation, the luminaire in accordance with the invention provides a light beam that is asymmetrical both in vertical and horizontal planes. If the luminaire is mounted to a mast beside a side of the road for traffic traveling in one direction, the light emission window being in a substantially horizontal position facing downward, and the screen facing the oncoming traffic, said screen provides natural shielding against light radiation, i.e. light emitted directly to the exterior by the lamp as well as light emitted after reflection, in horizontal directions and downward directions including a small angle, generally up to 10°, with the horizontal, as a result of which dazzling is precluded. Also the reflector itself and the side panel, which include larger angles with the main plane than the downward angle wherein the screen is active, contribute to this shielding effect. The screen generally includes an angle with the light emission window ranging between approximately 20 and approximately 25°.

The first reflector portion forms a main light beam that is latitudinally incident on one side of the road at a comparatively large distance from the luminaire and narrows in the direction of the luminaire, and that will predominantly illuminate the part of the side of the road situated on the side where the luminaire is arranged.

The second reflector portion provides a side beam which, near the mast, latitudinally illuminates a side of the road and, up to a larger distance from the mast, the opposite side of the roadway. The third reflector portion provides a light beam that completes the illumination by the first and the second beam. In addition, there is the light that is emitted directly, without previous reflection, by the lamp accommodated, and the light that is reflected by the screen and the side panel.

By virtue of the asymmetry of the luminaire in accordance with the invention, the luminaire can suitably be used to illuminate a side of the road for traffic that keeps to the left, the luminaire being mounted to a mast provided at the median strip of the road, and hence also to illuminate a side of the road for traffic that keeps to the right if the mast is arranged at the roadside, however, a mirror-inverted embodiment of said luminaire is necessary to illuminate, from the median strip of the road, a side of the road for traffic that keeps to the right, or to illuminate, from the roadside, a side of the road for traffic that keeps to the left.

An advantage of the luminaire in accordance with the invention resides in that it has a comparatively large range, so that comparatively few luminaires and hence few masts are necessary to illuminate a road length.

Favorably, the first reflector portion is bent in a direction along the screen. This results in an increased illumination intensity at a large distance from the luminaire.

To obtain a comparatively high luminous intensity at a large distance, the first reflector portion favorably extends over a distance such that it comprises facets that are intersected by the main plane. This results in a greater light emission over a large distance.

To obtain a satisfactory light distribution, the facets of the first reflector portion favorably have angular points that are situated at least substantially on a paraboloid. The axis of said paraboloid then coincides with the main axis, and the focus coincides with the optical center.

It is also favorable if the facets of the second reflector portion have angular points situated at least substantially on a paraboloid with a focus that coincides at least substantially with the optical center.

In general, the paraboloids of the first and the second reflector portion are different, and the paraboloid of the first reflector portion has a smaller focal distance. Owing to the difference in curvature between the reflector portions, said reflector portions are favorably interconnected by the third reflector portion if said reflector portion comprises triangular facets. These facets are elongated and extend along the screen, and they may additionally be embodied so as to be flat in order to spread the incident light.

The light reflected by the third reflector portion is efficiently used to complement the main beam and the side beam, but the distribution of the light reflected by said third reflector portion is not very critical. For this reason, the means for accommodating an electric lamp are favorably situated at least close to the third reflector portion, where they remove a reflective surface or render it inactive, if the reflector has an opening behind which the means are situated.

If the lamp to be used in the luminaire is a so-termed "double-ended" lamp, i.e. a lamp where current supply conductors enter the lamp at two opposite locations, the means for accommodating the lamp are divided. In this case, a first part is favorably situated near the third reflector portion, and a second part is arranged at the opposite side of the main plane. The use of a double-ended lamp is favorable because, also in the case of shocks and vibrations, such a lamp is in a well-defined position in the luminaire.

The use of a double-ended lamp is favorable also because it enables a lamp to be readily exchanged and the loss of useful reflector surface due to the presence of means for accommodating the lamp to be reduced. For this purpose, the reflector may comprise, between the portions of the means for accommodating the lamp, a removable part that, after it has been removed, renders the space enclosed by the reflector accessible to the lamp, and that is provided again after or simultaneously with the introduction of the lamp into the reflector. The removable part of the reflector may be connected to a removable part of a housing around the reflector, which, for example, may also support the means for accommodating the lamp.

The reflector may be made, for example, of a mirror bright metal or a semi-mirror bright metal to obtain a specular or substantially specular reflection.

In an attractive embodiment, the reflector, the screen and the side panel are provided with a lacquer coating including a specularly reflective reflection component. The lacquer coating also includes a diffusely reflecting reflection component. A luminaire comprising a reflector having such a lacquer coating is described in the non-prepublished European patent application 00 201 209.4 (PHNL000190). The lacquer coating includes a light-transmitting binder which comprises light-reflecting particles, but which is substantially free of said particles at its free surface. The particles may consist, for example, of halophosphate, calciumpyrophosphate, strontiumphosphate or titanium dioxide. Said particles may be surrounded by a pigment skin, for example aluminum oxide. The binder may be, for example, a silicone polymer, a fluoropolymer or an acrylate. The particles account for maximally 75% of the volume of the coating. An attractive aspect of the coating is its high reflection coefficient of 0.95 or more, and, in addition, the combination of specular reflection and diffuse reflection, causing images of the light source formed by the facets to merge gradually.

In an advantageous modification of the preceding embodiment, facets of the first reflector portion, that are remote from the side panel, are made of a reflective metal. This modification has the advantage that a part of the first reflector portion for obtaining a high luminous intensity at a comparatively large distance is highly specularly reflective.

In a further modification, the first reflector portion comprises facets which are intersected by the main plane and are made, together with adjoining facets of the first reflector portion, of a reflective metal. This modification has the advantage that, at a still larger distance from the luminaire, a high light intensity can be obtained.

In a particularization of these modifications, the lacquer coating of the facets bordering on the light emission window serves as the reflective surface. These facets bordering on the light emission window are the first parts of the reflector that are visible, in daylight, from a large distance. If these facets were to be reflective, they would be dark, at night, during operation of the luminaire because incident lamp light would be reflected in a strongly downward direction. The particularized modification has the advantage that the diffuse reflection component of the lacquer scatters the incident light, so that the facets are visible from a large distance without dazzling since their brightness is very low. They guide the road user as they indicate the direction of the road. They additionally provide an introduction to the higher luminances of the luminaire that will be observed as the distance to said luminaire decreases. In this manner, the so-termed "flash effect", i.e. the effect observed on a sunlit country road surrounded by trees, is counteracted.

The luminaire in accordance with these modifications and their particularization can be readily manufactured if the facets of reflective metal are present on a separate metal body that is attached to the reflector. In this case, the specular metal part does not have to be shielded when the coating is applied to a specular reflector. An additional advantage of this further modification resides in that a comparatively cost-effective optically low-grade material can be used for the reflector.

In general, the luminaire can also emit light in a vertical direction towards the base of the mast, and even rearward in the direction of flow of the traffic, said light being substantially non-reflected light. As a result, an object, such as an obstacle that is situated on the road surface near the mast, or beyond the mast viewed in the direction of flow, is illuminated by the luminaire at the surface facing the traffic. If said situation is compared to the situation where the object is situated some distance before the mast, viewed in the direction of flow of the traffic, it appears that in the latter situation the contrast between the object and the road surface is less pronounced so that the object cannot be observed as readily.

In a favorable embodiment, first shielding means are present to counteract the emission of unreflected light in an area of the light emission window that is bounded by the first and the third reflector portion and a plane through the optical center, transverse to the main plane and transverse to the light emission window. Said means may be a panel in the light emission window or a coating on a glass panel that seals off the light emission window, if such a glass panel is present.

It is attractive, however, if the first shielding means comprise a shield arranged in the reflector along the optical main axis and transversely to the main plane. This is advantageous because such a screen provides the desired shielding, and it essentially does not disturb the flow of rays reflected by the reflector, and it reflects light originating directly from the lamp in a favorable direction.

The first shielding means are useful to achieve said increase in contrast, but also to save energy. If said means are present, an average luminance of the road surface of 0.5 to 1 cd/m$^2$ is sufficient; if said means are absent, said value should be twice as high.

In the second reflector portion, second shielding means may be present in the light emission window to preclude that unreflected light is emitted sideways with respect to the main plane. This may be desirable if the reflector is comparatively shallow and hence the lamp is visible from the sides of the luminaire. If the luminaire is employed at the median strip of a road, these means counteract the emission of unreflected light in the direction of the other side of the road.

The means may comprise a lamella extending along the side axis. If necessary, one or two additional lamellae may be present.

When the luminaire in accordance with the invention is used at the shoulder of a road, there is a risk, for example, if the luminaire is arranged in a comparatively high position, or if the side of the road for oncoming traffic is comparatively narrow, that unreflected light that is directly emitted by the lamp from the luminaire to the exterior still lands on the other side of the road. This light travels in the same direction as the traffic on the other side of the road and hence reduces the contrast of obstacles present on said side of the road.

In a favorable embodiment, this risk is counteracted. In this embodiment, third shielding means extend along the main plane, at the first side thereof, which shielding means counteract the emission of unreflected light on said side of the main plane. By virtue thereof, the luminaire has a wider application, i.e. not only at the median strip of the road but also on comparatively high masts at the shoulder of the road, and even if the sides of the road are comparatively narrow the luminaire can be provided at the shoulder of the road. This can be attributed to the fact that the emission of unreflected light at comparatively large angles with the main plane has been counteracted. The third protection means may consist, for example, of one or more lamellae situated, for example, in the light emission window.

The reflector may be accommodated in a housing, and the light emission window may be sealed off by means of, for example, a flat glass panel. The luminaire can particularly suitably be used to accommodate an electric lamp with a compact light source. Owing to the high luminous flux of such a lamp, and the resultant high luminance of such a compact lamp, the lamp favorably is a high-pressure metal halide discharge lamp, for example a high-pressure metal halide discharge lamp having a rated power of 150 W, for example with a color temperature of 3000 or 4000 K. The lamp may have a discharge arc having a length of, for example 12 mm in a for example ceramic, such as aluminum oxide, discharge vessel having, for example, a diameter of approximately 12 mm. If the means for accommodating the lamp are situated only near the third reflector portion, the lamp obliquely intersects the optical main plane so as to include an acute angle therewith, when the discharge vessel is provided around the optical center.

The luminaire in accordance with the invention has a high efficiency, which can be attributed to the fact that double reflections in the luminaire are substantially precluded.

Embodiments of the luminaire in accordance with the invention are shown in the drawings, wherein FIG. 1 is a sectional view of a first embodiment wherein the reflector is shown in a side elevation in a housing;

Figure 1:
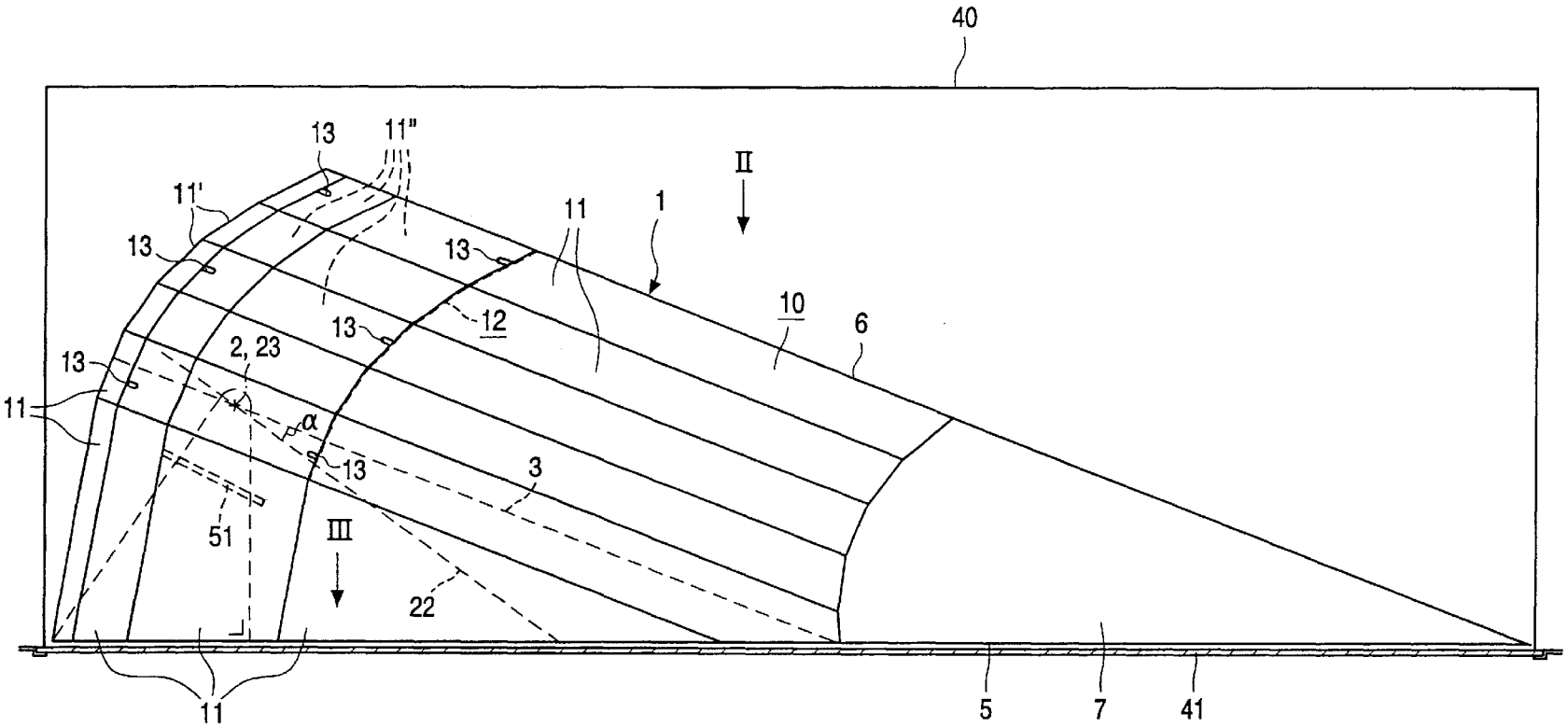

In FIG. 1, the luminaire comprises a reflector 1 in a housing 40 that is sealed off by means of a glass panel 41. In the position shown in the drawing, said luminaire may be arranged at the median strip of a roadway for traffic that keeps to the left, or at the shoulder of a roadway for traffic that keeps to the right, said traffic approaching from the right in this Figure. The luminaire may be rotated towards the roadway through a small angle of, for example, 10 to 15°.

Figure 2:
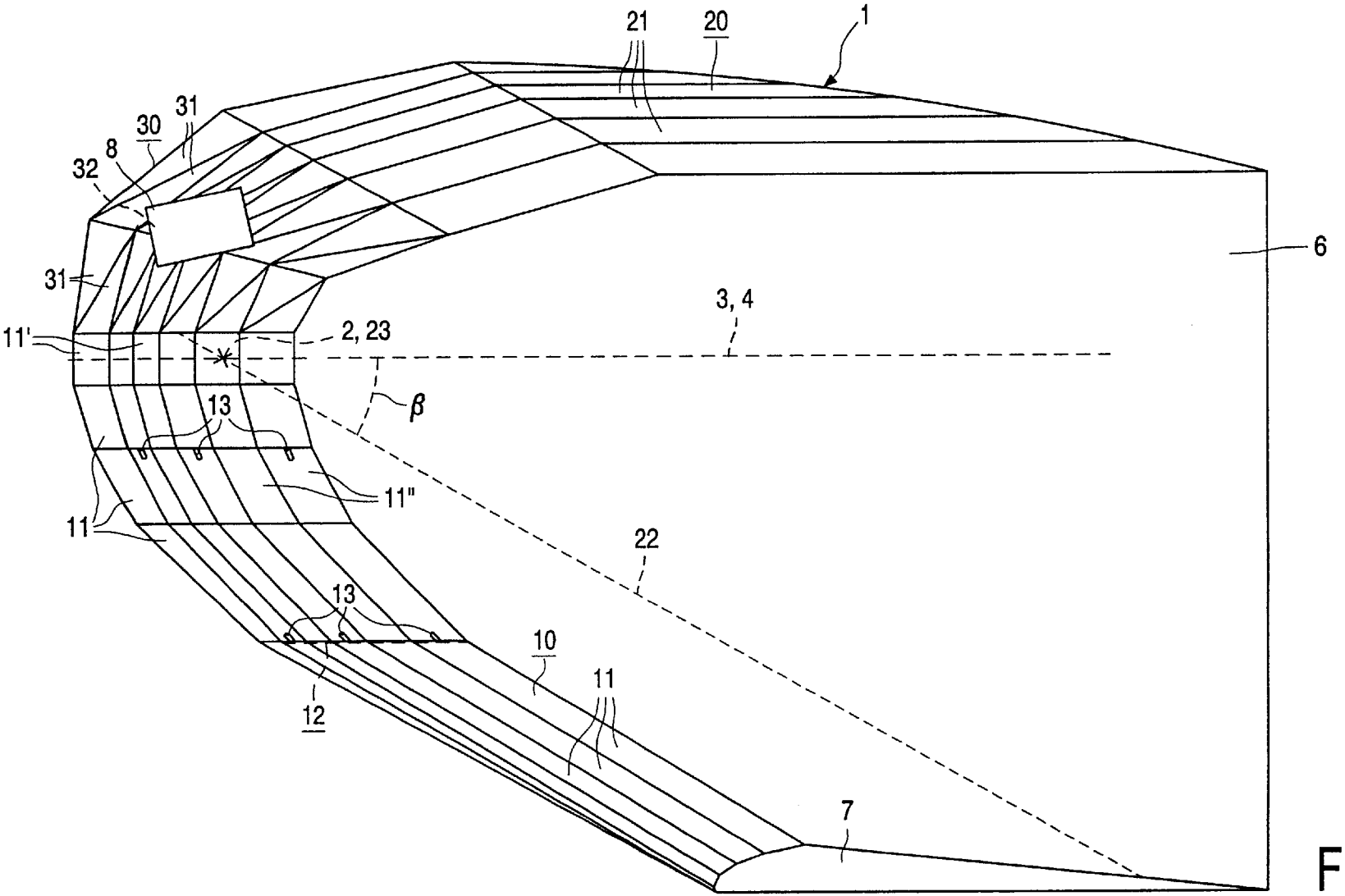
FIG. 2 shows the reflector in accordance with II in FIG. 1.

In FIGS. 1 and 2, the concave reflector 1 has an optical center 2 on an optical main axis 3, in an optical main plane 4. A light emission window 5 includes an acute angle, an angle of 22° in the Figures, with the optical main axis 3 and extends transversely to the optical main plane 4. A reflective screen 6 extends along the optical main axis 3, transversely to the optical main plane 4, into the light emission window 5. The screen 6 causes the reflector 1 to be elongated into the light emission window 5. A side panel 7 is situated at a first side of the main plane 4, contiguous to the screen 6, extends into the light emission window 5 and bounds the reflector 1. The luminaire comprises means 8 for accommodating an electric lamp with a light source, said light source being situated around the optical center 2. The reflector 1 comprises elongated facets 11, 11", 21 extending along the screen 6. If the luminaire is provided such that the light emission window 5 is in a horizontal position facing downward, the reflector 1 with the screen 6 and the side panel 7 make sure that the lamp to be accommodated is invisible and that, in operation, light is emitted at angles up to approximately 10° with the horizontal.

The reflector 1 comprises a first reflector portion 10 with facets 11, 11", which extends, on the first side of the main plane 4, from the side panel 7 up to at least close to the main plane 4, and defines the main axis 3 and the optical center 2. The reflector additionally comprises a second reflector portion 20 with facets 21, which extends, opposite the side panel 7, between the screen 6 and the light emission window 5, on a second side of the main plane 4. The second reflector portion 20 also has a side axis 22 which essentially extends through the optical center 2 and is essentially tilted in the optical center 2 with respect to the main axis 3. The side axis 22 is tilted towards the light emission window 5, see FIG. 1, so as to include an acute angle $\alpha$, an angle of 15° in the Figure, with the main axis 3 upon projection in the main plane 4, and said side axis is also tilted towards the side panel 7, see FIG. 2, so as to include an acute angle $\beta$, an angle of 30° in this Figure, with the main plane 4. The reflector also comprises a third, concave reflector portion 30 interconnecting the first reflector portion 10 and the second reflector portion 20.

In the embodiment shown, the first reflector portion 10 is bent in a direction along the screen 6.

The first reflector portion 10 also has facets 11' which are intersected by the main plane 4.

The facets 11, 11', 11" of the first reflector portion 10 have angular points that are situated at least substantially on a paraboloid. With the exception of angular points situated in the light emission window, all angular points of the facets 11, 11', 11" are situated at least substantially on a paraboloid. In the Figures, the paraboloid has a focal distance of approximately 32 mm. As shown in FIG. 1, angular points in the light emission window are not situated on the paraboloid in order to preclude reflected light from being emitted at angles with the horizontal that are too small, i.e. angles below approximately 10°. For the same reason, the side panel 7 favorably includes an acute angle, for example an angle of 75 to 80°, with the light emission window.

The facets 21 of the second reflector portion 20 have angular points situated at least substantially on a paraboloid with a focus 23 that coincides at least substantially with the optical center 2. This paraboloid has a focal distance of approximately 43 mm.

The third reflector portion 30 has triangular facets 31 due to the difference in curvature between the first reflector portion 10 and the second reflector portion 20. By virtue of the triangular shape, however, the facets 31 are flat too. In FIG. 2, a parabola extends through the angular points at the interface between the two rows of facets 31 shown, the focal distance being 37.5 mm in the drawings.

The means 8 for accommodating an electric lamp are present near the third reflector portion 30. In the embodiment shown, the third reflector portion 30 has an opening 32 behind which the means 8 are situated outside the reflector 1, see FIG. 2.

The reflector 1, the screen 6 and the side panel 7 are provided with a lacquer coating which is partly specularly reflective. The coating comprises 75% by volume of a light-transmitting silicone binder and 25% by volume of light-reflecting particles of titanium dioxide with an aluminum oxide skin. The free surface of the coating is substantially free of particles. Titanium dioxide and aluminum oxide have different refractive indices, i.e. approximately 2.32 and 1.63, respectively, as a result of which the specular reflection of the lacquer is further enhanced.

Facets 11' of the first reflector portion 10, which are remote from the main plane 4 and the side panel 7, are made of reflective metal, for example aluminum, such as anodized aluminum, for example mirror-bright aluminum, however, in general a semi-mirror bright aluminum, as shown in the Figures, is used.

In the case of the facets 11 bordering on the light emission window 5, the lacquer coating serves as the reflective surface.

The facets 11" of a reflective metal are situated on a separate metal body 12, which is attached to the reflector 1 by means of, in the Figures, tongues 13 attached to said body 12, which are inserted into openings in the reflector 1 and subsequently bent or twisted.

First shielding means 51, see FIG. 1, are present to counteract the emission of unreflected light in an area of the light emission window 5 that is bounded by the first and the third reflector portion 10, 30 and a plane through the optical center 2, transverse to the main plane 4 and transverse to the light emission window 5.

The first shielding means 51 comprise a shield arranged in the reflector 1 so as to extend along the optical main axis 3 and transversely to the main plane 4.

Figure 3:
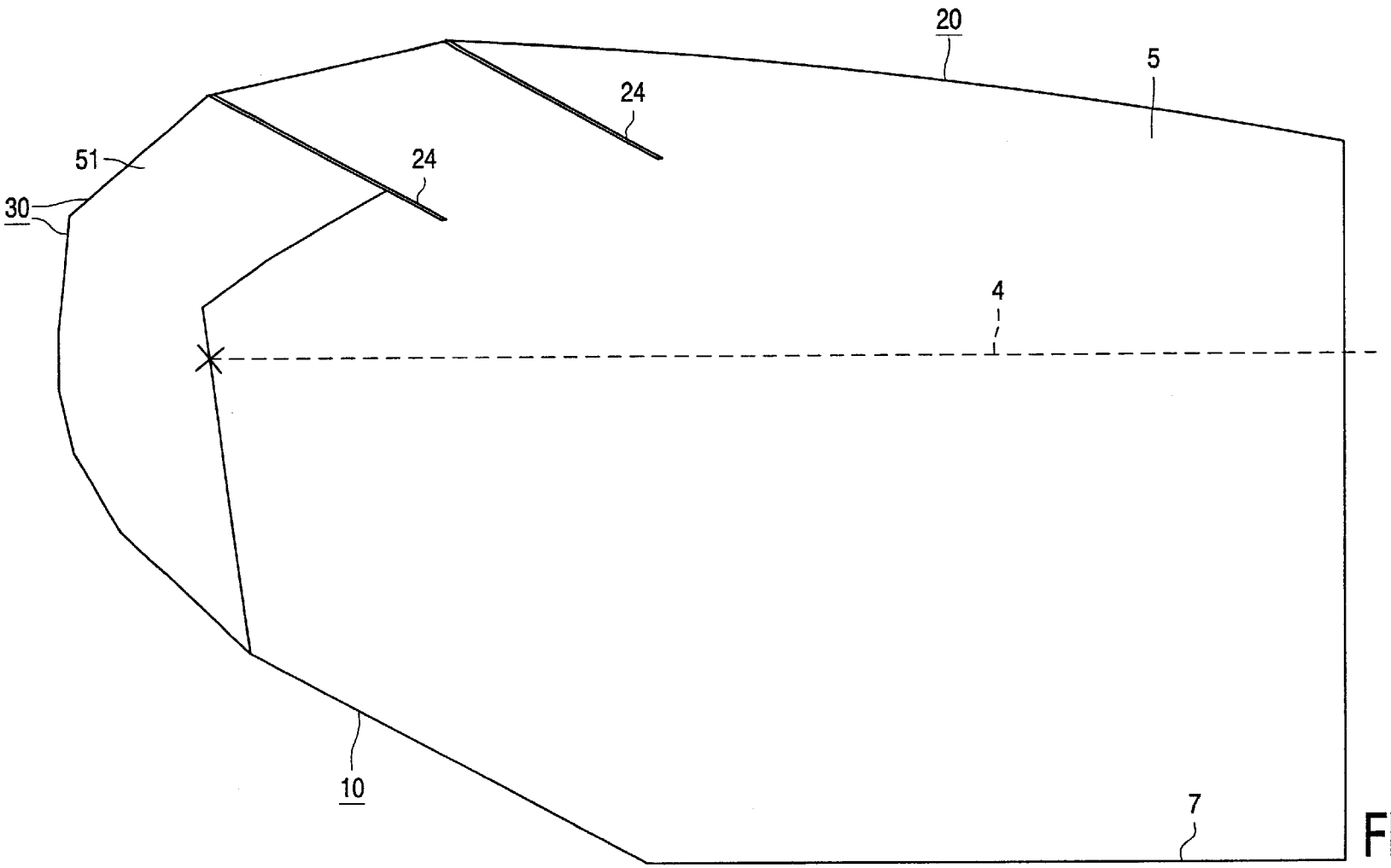
FIG. 3 shows the light emission window of a modification in accordance with III in FIG. 1.

The reference numerals used in FIG. 3 have the same meaning as in FIGS. 1 and 2. A shield that serves as the first shielding means 51 is provided in the light emission window 5. At the location of the second reflector portion 20, second shielding means 24 are present in the light emission window 5 to counteract that unreflected light is emitted sideways with respect to the main plane 4. In FIG. 3, the means 24 consist of two lamellae extending at right angles to the light emission window 5, which lamellae are connected to the second reflector portion 20 and extend along the side axis 22.

Figure 4:
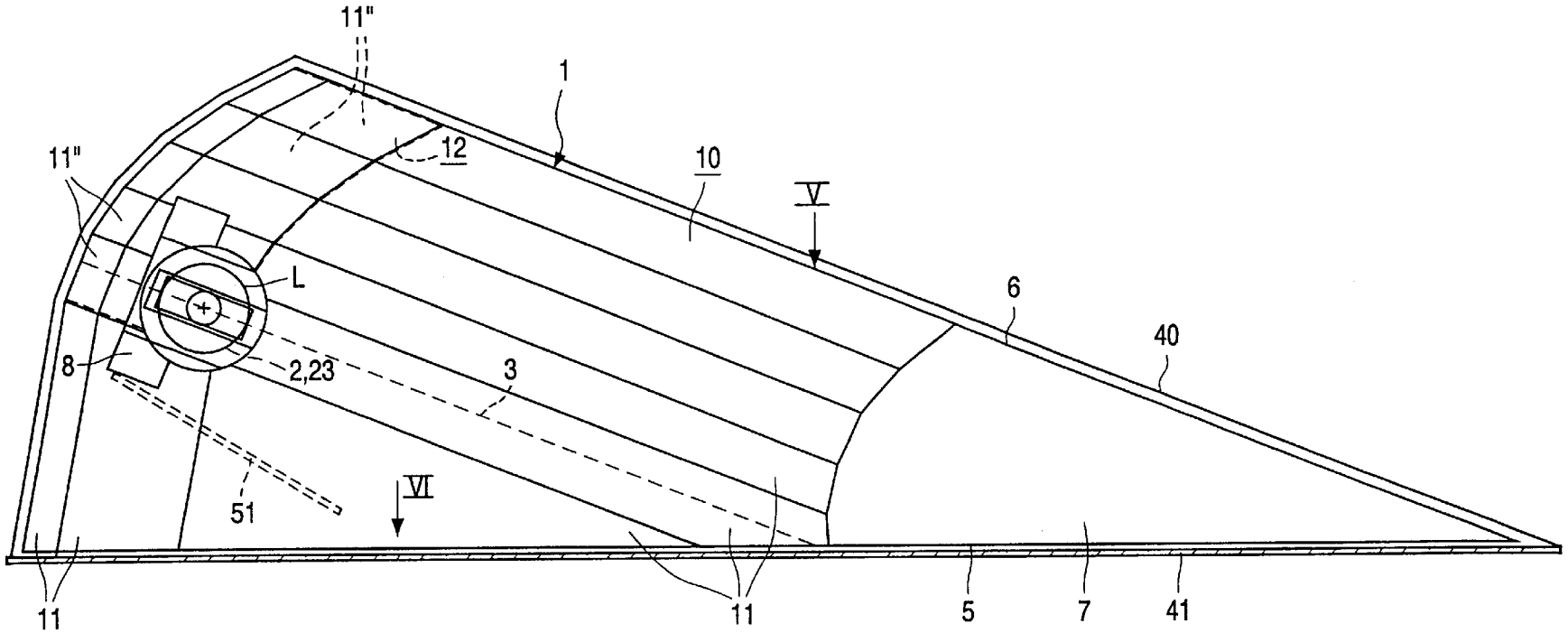
FIG. 4 shows a second embodiment represented in accordance with FIG. 1.
Figure 5:
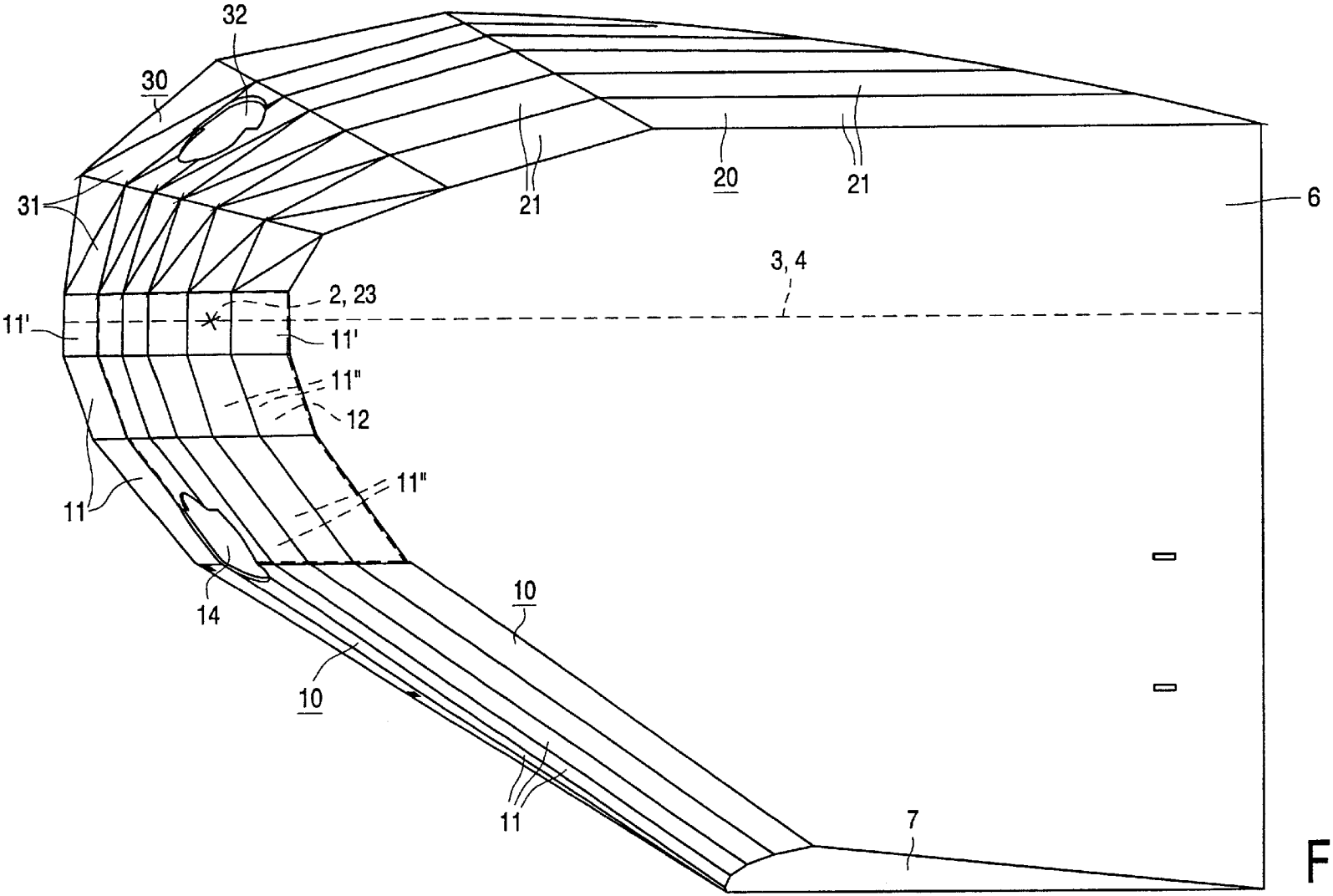
FIG. 5 shows the reflector in accordance with V in FIG. 4.
Figure 6:
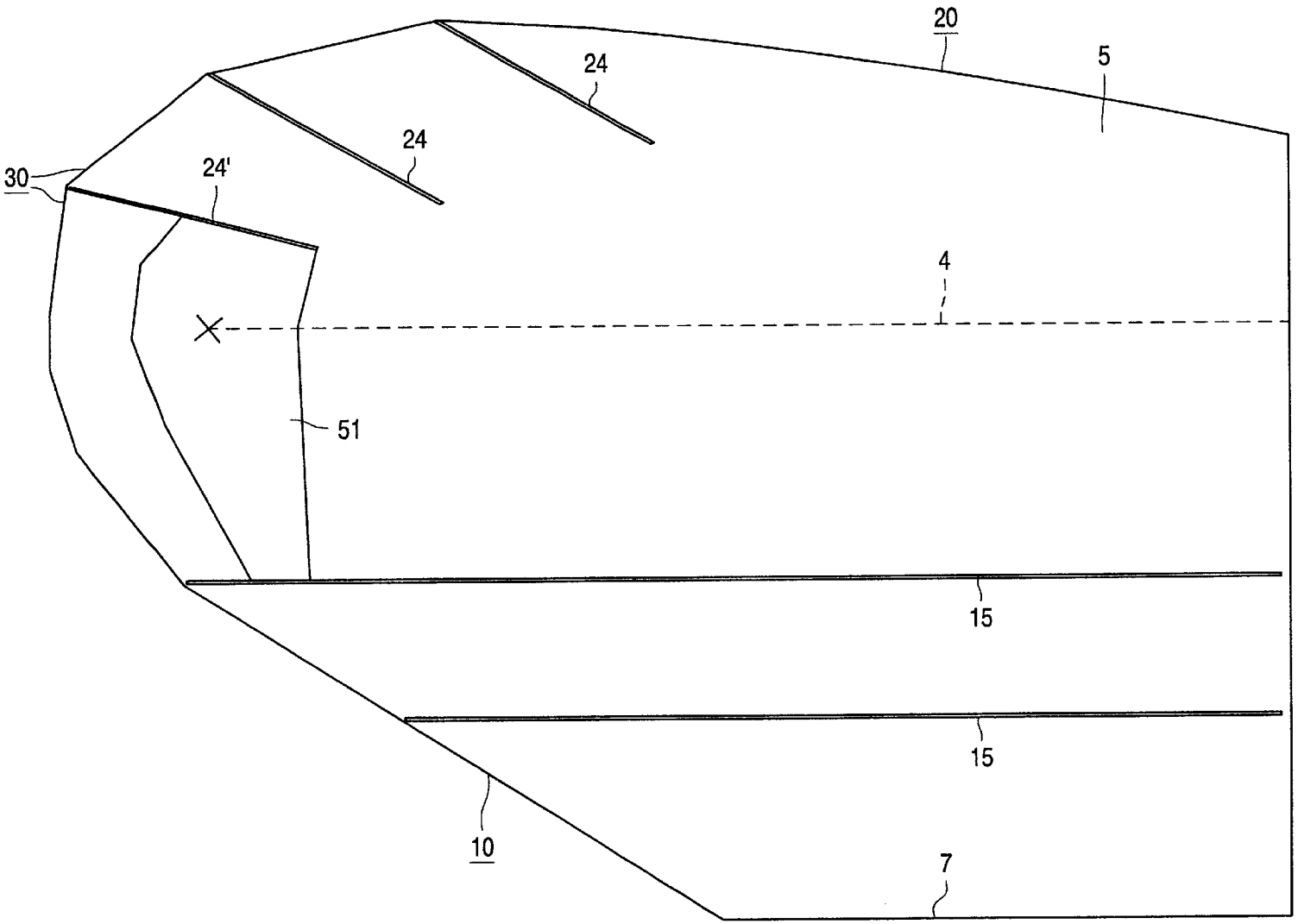
FIG. 6 shows the light emission window in accordance with VI in FIG. 4.

In FIGS. 4 through 6, parts corresponding to parts shown in FIGS. 1 through 3 are indicated by means of the same reference numerals.

In FIG. 4, the housing 40 is substantially identical in shape to the optical system of the luminaire, so that said luminaire is comparatively light in weight and compact, as a result of which it catches comparatively little wind and can suitably be mounted on a comparatively light mast.

The means 8 for accommodating the lamp L are made in two parts, as a result of which a double-ended lamp L is accommodated. As shown in FIG. 5, the reflector 1 has two openings: opening 32 in the third reflector portion 30 and opening 14, arranged opposite opening 32 on the other side of the main plane 4 in the first reflector portion 10, through which the lamp L can be inserted into the two-part means 8 arranged near said openings.

Other differences from the first embodiment are shown in FIG. 5. The first reflector portion 10 has only four rows of facets 11, 11', whereas the first embodiment comprises five rows of facets. The first reflector portion 10 causes the light reflected by said facets to have a greater spread in directions transverse to the main plane 4. Three rows of facets, i.e. the facets 11' intersected by the main plane 4, with the exception of the facet 11' bordering on the light emission window 5, and the two adjoining rows of facets 11", also with the exception of the facets 11 bordering on the light emission window 5, have a specularly reflecting surface owing to the presence of a separate metal body 12 which is attached to the reflector 1. The first reflector portion 10 thus forms a beam having a larger range.

In FIG. 6, third shielding means 15 extend along the main plane 4, on the first side thereof, which shielding means counteract the emission of unreflected light on said side of the main plane 4. The means consist of elongated lamellae extending at right angles to the light emission window 5. The effect of the second shielding means 24 near the second reflector portion 20 is enhanced by a partition 24' extending at right angles to the light emission window 5. Said partition 24' extends in the plane where the interface between the two rows of triangular facets 31 of the third reflector portion 30 is situated.

In the luminaire in accordance with FIGS. 1 through 3 as well as in the luminaire in accordance with FIGS. 4 through 6, a 150 W metal halide discharge lamp in a ceramic lamp vessel is used as the light source. The light beams were measured. In the former case, the light beam has a maximum intensity of 760 cd/klm, in the latter case, however, the maximum intensity is 990 cd/klm. In the first example, the luminaire has an efficiency of 74.5%, i.e. 74.5% of the light generated by the lamp is emitted by the luminaire; in the second example, the efficiency is 78.5%. These improvements are achieved by avoiding light losses caused by internal reflections and by more efficiently using the light through limiting direct lateral light emission.

The luminaire in accordance with the invention may also comprise combinations of above-described features that are different from the combinations described in the claims.

What is claimed is:

1. A luminaire comprising:

a concave reflector (1) with an optical center (2) on an optical main axis (3) in an optical main plane (4);

a light emission window (5) which includes an acute angle with the optical main axis (3) and extends transversely to the optical main plane (4);

a reflective screen (6) which extends along the optical main axis (3) of the reflector (1) up to the light emission window (5), and extends transversely to the optical main plane (4);

a side panel (7) at a first side of the main plane (4), contiguous to the screen (6), which reaches into the light emission window (5) and bounds the reflector (1);

means (8) for accommodating an electric lamp with a light source, which light source is situated around the optical center (2), which reflector (1) comprises elongated facets (11, 11" 21) which extend along the screen (6), characterized in that the reflector (1) is provided with:

a first reflector portion (10) with facets (11, 11'), which extends, on the first side of the main plane (4), from the side panel (7) to at least close to the main plane (4), and defines the main axis (3) and the optical center (2), a second reflector portion (20) with facets (21), which extends opposite the side panel (7) between the screen (6) and the light emission window (5), on a second side of the main plane (4), which second reflector portion has a side axis (22) which extends essentially through the optical center (2) and is tilted essentially in the optical center (2) with respect to the main axis (3)

towards the light emission window (5) so as to include an acute angle $\alpha$ with the main axis (3) upon projection in the main plane (4), and towards the side panel (7) to include an acute angle $\beta$ with the main plane (4); and a third concave reflector portion (30) interconnecting the first reflector portion (10) and the second reflector portion (20).

2. A luminaire as claimed in claim 1, characterized in that the first reflector portion (10) is bent in a direction along the screen (6).

3. A luminaire as claimed in claim 2, characterized in that the first reflector portion (10) comprises facets (11') which are intersected by the main plane (4).

4. A luminaire as claimed in claim 2, characterized in that the facets (11, 11', 11") of the first reflector portion (10) have angular points situated at least substantially on a paraboloid.

5. A luminaire as claimed in claim 1, characterized in that the facets (21) of the second reflector portion (20) have angular points situated at least substantially on a paraboloid with a focus (23) that coincides at least substantially with the optical center (2).

6. A luminaire as claimed in claim 1, characterized in that the third reflector portion (30) has triangular facets (31).

7. A luminaire as claimed in claim 1, characterized in that the means (8) for accommodating an electric lamp are at least present near the third reflector portion (30).

8. A luminaire as claimed in claim 1, characterized in that the reflector (1), the screen (6) and the side panel (7) are provided with a lacquer coating including a specularly reflective reflection component.

9. A luminaire as claimed in claim 8, characterized in that facets (11") of the first reflector portion (10), that are remote from the side panel (7), are made of a reflective metal.

10. A luminaire as claimed in claim 9, characterized in that the first reflector portion (10) comprises facets (11') which are intersected by the main plane (4) and are made, together with adjoining facets (11") of the first reflector portion (10), of a reflective metal.

11. A luminaire as claimed in claim 9, characterized in that the lacquer coating of the facets (11, 11') bordering on the light emission window (5) serves as the reflective surface.

12. A luminaire as claimed in claim 9, characterized in that the facets (11") of reflective metal are present on a separate metal body (12) that is attached to the reflector (1).

13. A luminaire as claimed in claim 1, characterized in that first shielding means (51) are present to counteract the emission of unreflected light in an area of the light emission window (5) which is bounded by the first and the third reflector portion (10, 30) and a plane through the optical center (2), transverse to the main plane (4) and transverse to the light emission window (5).

14. A luminaire as claimed in claim 13, characterized in that the first shielding means (51) comprise a shield arranged in the reflector (1), along the optical main axis (3) and transversely to the main plane (4).

15. A luminaire as claimed in claim 1, characterized in that at the location of the second reflector portion (20), second shielding means (24) are present in the light emission window (5) to counteract that unreflected light is emitted sideways with respect to the main plane (4).

16. A luminaire as claimed in claim 15, characterized in that the second shielding means (14) comprise a lamella that extends along the side axis (22).

17. A luminaire as claimed in claim 1, characterized in that third shielding means (15) extend along the main plane (4), on the first side thereof, which shielding means counteract the emission of unreflected light on said side of the main plane (4).

* * * * *